US005437696A

United States Patent [19]

Verkade et al.

[11] Patent Number: 5,437,696

[45] Date of Patent: Aug. 1, 1995

[54] METHOD OF REMOVAL OF SULFUR FROM COAL AND PETROLEUM PRODUCTS

[75] Inventors: John G. Verkade; Thyagarajan Mohan; Robert J. Angelici, all of Ames, Iowa

[73] Assignee: Iowa State University Research Foundation, Inc., Ames, Iowa

[21] Appl. No.: 263,553

[22] Filed: Jun. 22, 1994

[51] Int. Cl.[6] ..... C10L 9/00; C10L 9/02

[52] U.S. Cl. ..... 44/622; 44/623; 44/624

[58] Field of Search ..... 44/624, 622

[56] References Cited

U.S. PATENT DOCUMENTS

| | | | |
|---|---|---|---|
| 3,988,120 | 10/1976 | Chia | 44/622 |
| 4,097,244 | 6/1978 | Burk, Jr. et al. | 44/624 |
| 4,391,609 | 7/1983 | Kalvinskas et al. | 44/15 R |
| 4,497,636 | 2/1985 | Aida et al. | 44/622 |
| 5,248,413 | 9/1993 | Stencel et al. | 44/622 |

FOREIGN PATENT DOCUMENTS 4207299 11/1993 Germany .

OTHER PUBLICATIONS

J. Albrecht et al., "Silica-Supported Phosphine Oxide Catalyst for the Disproportionation of Aryl- or Alkylhalodisilanes to Aryl- or Alkylhalomono- and Polysilanes", German Patent Document DE 4207299 A1 (Nov. 25, 1993), *Chem. Abstr., 120,* Abstract No. 191994f (1994).

R. A. Amos et al., "Reductive Cleavage of Aromatic Disulfides Using a Polymer-Supported Phosphine Reagent," *J. Org. Chem., 49,* 2637-2639 (1984) Jan.

R. Badilla-Ohlbaum et al., "A Study of Nickel-Molybdate Coal-Hydrogenation Catalysts Using Model Feedstocks," *Fuel, 58,* 309-314 (Apr. 1979).

B. L. Booth et al., "The Synthesis of Silica-Supported Phosphine and Phosphine Oxide Complexes of Manganese(II) Iodide and their Reaction with Sulphur Dioxide," *J. Chem. Soc. Dalton Trans.,* 1415-1417 (1987) month N/A.

B. L. Booth et al., "A Comparison of the Efficiencies of Polymer-supported Phosphine and Phosphine Oxide Complexes of Manganese(II), $MnX_2(P)C_6H_4PPh_2$) and $MnX_2[(P)C_6H_4P(O)Ph_2]_n$(n=2 or 4; X=Cl, Br, or I), for the Absorption of Sulphur Dioxide", *J. Chem. Soc. Dalton Trans.,* 2959-2961 (1987). Month N/A.

W. H. Calkins, "The Chemical Forms of Sulfur in Coal: A Review," *Fuel, 73,* 475-483 (1994) Month N/A.

K. Chatterjee et al., "Toward Organic Desulfurization. The Treatment of Bituminous Coals with Strong Bases", *Energy & Fuels, 5,* 704-707 (1991) Month N/A.

Y. Chen et al., "Synthesis of Polysiloxane-Supported Phosphine-Platinum, Phosphine-Rhodium Complexes and Their Catalytic Behavior for Hydrosilylation of Olefins", *Yingyong Huaxue,* 6, 1-5 (1989); *Chem. Abstr., 112,* Abstract No. 98793q (1990) Month N/A.

C. L. Chernick et al., "Thermochemistry of Organophosphorus Compounds, Part III. The Heat of Addition of Sulphur to Triethyl Phosphite, and to Tri-*n*-propyl- and Tri-*n*-butyl-phospine," *J. Chem. Soc.,* 1851-1854 (1957) Month N/A.

D. J. Darensbourg et al., "Nucleophilic Addition of a Water-Soluble Phosphine to Aldehydes. Isolation of (1-Hydroxyalkyl)phosphonium Salts and the Crystal Structure of the (1-Methoxy-1-benzyl)-(*m*-sulfonatophenyl)diphenylphosphonium Salt," *Inorg. Chem., 33,* 175-177 (1994). Month N/A.

Y. A. Dorfman et al., "Oxidative phosphorylation of butanol by red phosphorus", *Kinet. Katal., 32,* 188-91 (1991); *Chem. Abs., 114,* Abstract No. 247402g (1991). Month N/A.

(List continued on next page.)

*Primary Examiner*—Ellen M. McAvoy
*Attorney, Agent, or Firm*—Schwegman, Lundberg & Woessner

[57] ABSTRACT

A method for the removal of sulfur from sulfur-bearing materials such as coal and petroleum products using organophosphine and organophosphite compounds is provided.

45 Claims, No Drawings

OTHER PUBLICATIONS

J. J. Eisch et al., "Desulfurization of Organic Compounds and Coal-Derived Liquids by Novel Transition Metal Complexes," *Am. Chem. Soc., Div. Fuel Chem., 27,* 78–84 (1982), paper presented at the American Chemical Society, Division of Fuel Chemistry Meeting, Kansas City, Mo., Sep. 12–17, 1982.

T. Engelbach, "Ueber die Destillationsproducte fossiler und anderer Substanzen als Beleuchtungsmittel, und Untersuchung der Destillationsproducte des bituminösen Sandes von Heide in Holstein", *Ann. Chem. Pharm.,* 1–26 (1857) Month N/A.

A. B. Garcia et al., "Hydrodesulfurization of a High Organic Sulfur Spanish Lignite with Impregnated Nickel Sulfate," *Coal Preparation,* 9, 185–197 (1991) Month N/A.

A. B. Garcia et al., "Comparative Performance of Impregnated Molybdenum-Sulfur Catalysts in Hydrogenation of Spanish Lignite," *Fuel, 68,* 1613–1616 (Dec. 1989).

A. P. Ginsberg et al., "Disulfur and Diselenium Complexes of Rhodium and Iridium," *Inorg. Chem., 21,* 3666–3681 (1982). Month N/A.

P. Grange, "Catalytic Hydrodesulfurization," *Catal. Rev.—Sci. Eng., 21,* 135–181 (1980) Month N/A.

J. Hoots, "Desulfurization of Solid-State Metal Sulfides," Ph.D. Thesis, University of Illinois, pp. 133–183 (1984) Month N/A.

A. Iannibello et al., "Modeling the Hydrotreating Reactions of a Heavy Residual Oil in a Pilot Trickle-Bed Reactor," *Ind. Eng. Chem. Process Des. Dev., 24,* 531–537 (1985) Month N/A.

D. R. Kilanowski et al., "Kinetics of Hydrodesulfurization of Benzothiophene Catalyzed by Sulfided Co-Mo-/$Al_2O_3$," *Journal of Catalysis, 62,* 70–78 (1980) Month N/A.

G. J. Kubas et al., "Synthesis, Characterization, and Reactions of Iron-Sulfur Clusters Containing the $S_2$ Ligand: $[Cp_2Fe_2(S_2)(SR)_2]^{0.1+}$, $[Cp_4Fe_4S_5]^{0.1+2+}$, and $[Cp_4Fe_4S_6]$," *Inorg. Chem., 20,* 2667–2676 (1981) Month N/A.

J. Laine et al., "The Effect of Composition and Pretreatment on the Activity of Nickel-Molybdenum Based Hydrodesulfurization Catalysts," *Ind. Eng. Chem. Prod. Res. Dev., 18,* 329–332 (1979) Month N/A.

E. J. Markel, "Catalytic Hydrodesulfurization by Supported Organometallic Sulfide Clusters and Topotactic Molybdenum Nitride", *Dissertation Abstracts International, 51,* 2494–B (Nov. 1990).

D. C. McCulloch, "Catalytic Hydrotreating in Petroleum Refining," in *Applied Industrial Catalysis, vol. 1*; B. E. Leach, Ed.; Academic Press; New York; pp. 69–121 (1983) Month N/A.

F. Mercier et al., "A New Type of Water-Soluble Phosphine for Biphasic Catalysis," *J. Organomet. Chem., 462,* 103–106 (1993) Feb.

T. N. Mitchell et al., "Approaches to New Water-Soluble Phosphines," *J. Organomet. Chem., 436,* 43–53 (1992) Month N/A.

T. Mohan et al., "Determination of Total Phenol Concentrations in Coal Liquefaction Resids by $^{31}P$ NMR Spectroscopy," *Energy & Fuels, 7,* 222–226 (1993) Month N/A.

M. Nagai et al., "Desulfurization of Benzonaphthothiophenes and Dibenzothiophene with a Raney Nickel Catalyst: Its Relationship to $\pi$-Electron Density" in *Polynuclear Aromatic Compounds;* L. B. Ebert, Ed.; American Chemical Society: Washington, D.C.; pp. 357–366 (1988) Month N/A.

G. A. Olah et al., "Reduction of Carbonyl Compounds to Hydrocarbons with Triisopropyl Phosphite: An Inexpensive New Reducing Agent," *Synlett,* 54–56 (Jan. 1990).

*Phosphorus-31 NMR Spectroscopy in Stereochemical Analysis;* J. G. Verkade et al., Ed.; VCH Publishers, Inc.: Deerfield Beach, Fla. (1987). (Title page and table of contents, pp. xi–xvi) Month N/A.

C. Rong et al., "Quantum Chemical Study of $MoS_2$ Hydrodesulfurization Catalysts," *J. Mol. Catal.,* 64, 321–335 (1991) Month N/A.

C. N. Satterfield, "Hydrodesulfurization" *Heterogeneous Catalysis in Industrial Practice;* Second Edition; McGraw-Hill, Inc.: New York; Chapter 9.9, pp. 378–383 (1991) Month N/A.

J. G. Speight, *The Desulfurization of Heavy Oils and Residua;* Marcel Dekker, Inc.: New York (1981) Month N/A (Title page and table of contents (pp. vii–ix)).

L. M. Stock et al., "Sulfur Distribution in American Bituminous Coals," *Energy & Fuels, 3,* 651–661 (Nov./-Dec. 1989).

J. Surygala et al., "Study of the activity of coal liquid hydrogenation catalysts. Hydrogenation and hydrodesulfurization of model compounds", Abstract of *Koks. Smola. Gas., 32,* 154–157 (1987) Month N/A.

J. G. Verkade, "Heteronuclear Probes of Coal Structure and Reactivity", *Abstracts and Research Accomplishments of University Coal Research Projects,* 20–21 (Jun. 1993).

(List continued on next page.)

OTHER PUBLICATIONS

J. G. Verkade, "Heteronuclear Probes of Coal Structure and Reactivity", *Abstracts and Research Accomplishments of University Coal Research Projects* (Jun. 1994).

J. G. Verkade, "$^{31}$P NMR Spectroscopy in the Analysis of Coal Materials" in $^{31}$P NMR Spectral Properties in Compound Characterization and Structural Analysis; L. D. Quin et al., Eds.; VCH Publishers: New York; Chapter 28, pp. 373–384 (1994) Month N/A.

J. G. Verkade, "Heteronuclear Probes of Coal Structure and Reactivity," Abstract of Department of Energy Grant No. FG22–92PC92531. This abstract was obtained from the Dialog online database Federal Research in Progress Apr. 1994.

D. D. Whitehurst, "Catalysis by Heterogenized Transition–Metal Complexes," *Chemtech,* 44–49, (Jan. 1980).

M. C. Ye et al., "New $^{119}$Sn NMR Tagging Reagents for Labile Hydrogen Functional Group Analysis," *Energy & Fuels, 8,* 172–178 (1994) Month N/A.

METHOD OF REMOVAL OF SULFUR FROM COAL AND PETROLEUM PRODUCTS

STATEMENT OF GOVERNMENT RIGHTS

The present invention was made with the support of DOE/TETC UCR Grant DE-FG22-92PC92531. The Government has certain rights to this invention.

BACKGROUND OF THE INVENTION

Chemical methods for removing sulfur from coal currently being developed include oxidation (e.g., using oxygen, air, ferric sulfate, chlorine, nitrogen oxides, nitric acid, ozone, or hydrogen peroxide); caustic leaching; and reduction with hydrogen, zerovalent metals, and single electron transfer agents. Other methods include supercritical extraction with ethanol, and combination methods such as a three-step sequence of charting, acid leaching, and hydrodesulfurization. Microbial and "super-base" desulfurization is also being studied as is deoxygenation of phenols by CO via metal complexes. Sonication has also been employed to enhance oxidative desulfurization. For coal liquids, hydrodesulfurization (using hydrogen with or without supported molybdenum and cobalt catalysts) can remove approximately 90% of the organic sulfur under elevated pressure at temperatures up to 500° C. None of these methods is yet completely satisfactory, however, especially for organically bound sulfur.

Coordination complexes such as $Ir(S_2)(dppe)_2^+$ and $Cp_4Fe_4S_6$ are known to lose all or part of their sulfur to phosphines ($PR_3$) to form phosphine sulfides ($R_3P{=}S$). See, A. P. Ginsberg et al., *Inorg. Chem,* 21, 3666 (1982) and G. J. Kubas et al., *Inorg. Chem.,* 20, 2667 (1981). More, recently it was shown that $PR_3$ compounds can reduce $FeS_2$ to $Fe_{0.95}S$ upon heating and that iron can remove sulfur from $(n\text{-}Bu)_3P{=}S$ at 300° C. to give FeS. The FeS2 in Springfield No. 5 coal also was converted to FeS in the presence of (n-Bu)3P and Nujol at 260° C. See, J. Hoots, Ph.D. Thesis, University of Illinois (1984), pages 133–183. However, this was not particularly efficient as only part of the sulfur was removed.

A severe problem with sulfur-bearing coals is that much, if not most, of the organic sulfur is present as thiophenes, which are particularly resistant to chemical desulfurization. See, L. M. Stock et al., *Energy and Fuels,* 3, 651 (1989) and W. H. Calkins, *Fuel,* 73,475 (1994). A specific example of such a thiophene is dibenzothiophene (DBT).

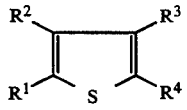

thiophenes

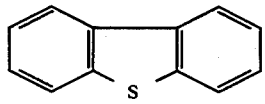

DBT

Thus, what is needed is a method for the effective and efficient removal of sulfur from coal or other sulfur-containing petroleum products, particularly those materials containing significant amounts of organically bound sulfur.

SUMMARY OF THE INVENTION

The present invention is directed to methods of removing at least a portion of sulfur from sulfur-bearing materials such as coal (including coal-derived products) and petroleum products (e.g., heavy residua or discarded tires), i.e., whether in a solid or liquid form. Using the methods of the present invention, preferably greater than about 50% of the total sulfur is removed, more preferably at least about 70% of the total sulfur is removed, and most preferably at least about 90% of the total sulfur is removed. Certain preferred embodiments of the method for solids, i.e., solid coal and petroleum products, involve contacting a sample of the material under a reduced pressure with an organophosphorus compound of the formula PR3 (phosphines) or P(OR)3 (phosphites), wherein each R is independently an aliphatic or aromatic group; and heating the mixture at a temperature (preferably at least about 150° C.) and for a time sufficient to remove at least a portion of the sulfur from the coal. For liquid coal and petroleum products (which can also include "semiliquids") reduced pressure is not required for advantageous results.

The organophosphorus compound is preferably a phosphine or phosphite wherein each R is independently a $(C_{1\text{-}50})$aliphatic group or a $(C_{5\text{-}50})$aromatic group. Particularly preferred organophosphorus compounds are those in which R is a $(C_{2\text{-}8})$alkyl group or a $(C_{6\text{-}10})$aryl group. Preferably, the organophosphorus compound is a phosphine. In certain preferred embodiments, the organophosphorus compound is water soluble. In other preferred embodiments in which the sulfur-containing material is a liquid, the; organophosphorus compound is bound to a solid support.

The removal of sulfur from coal and petroleum products, whether solid or liquid, can be enhanced by the use of a metal catalyst having a metal in the +2 or +3 oxidation state. Typically, this catalyst is present in the reaction mixture, e.g., organophosphorus compound and coal or petroleum product, during the heating step. Also, the removal of sulfur from sulfur-bearing materials such as coal or petroleum products, whether solid of liquid, can be enhanced by the use of a metal sulfide compound. This can be present in the reaction :mixture during the heating step or it can be used subsequent thereto. It could also be present in a separate container. For example, the organophosphine sulfide formed upon abstraction of sulfur by the organophosphine compound can be removed from the reaction mixture, conveyed to a container having therein the metal sulfide, and the regenerated organophosphorus compound returned to the reaction mixture to remove more sulfur.

The removal of sulfur from coal and petroleum products can be made catalytic through the use of hydrogen, which regenerates the organophosphine compound from the organophosphine sulfide. The, hydrogen can be added directly to the reaction mixture (e.g., the organophosphorus compound and coal or petroleum product) wherein the organophosphorus sulfide compound is formed, either as the organophosphorus sulfide is being formed or subsequent thereto. Alternatively, the organophosphorus sulfide can be removed from the reaction mixture, conveyed to a container wherein it is contacted with hydrogen, and the regenerated organophosphorus compound returned to the reaction mixture to remove more sulfur from the coal or petroleum product.

DETAILED DESCRIPTION

The present invention provides methods for the effective and efficient removal of sulfur from sulfur-bearing materials, i.e., coal and petroleum products, such as coal, petroleum feedstocks, heavy petroleum residua, coal liquids, and discarded tires. These methods use organophosphorus compounds and are particularly effective for those materials containing a high concentration of organically bound sulfur. Preferred embodiments of the methods of the invention remove sulfur under catalytic conditions using hydrogen to regenerate the organophosphorus compound from the corresponding organophosphorus sulfide compound, which is formed upon abstraction of sulfur from the coal or petroleum product.

The methods of the present invention involve combining an organophosphorus compound with a sample of the sulfur-bearing material and heating this mixture at a temperature and for a time effective to remove at least a portion of the sulfur. Typically, a stoichiometric or excess amount of organophosphorus compound, based on the total amount of sulfur present in the sample of sulfur-bearing material is used in the, reaction mixture. Preferably, however, for solid samples of sulfur-bearing materials a large excess is used such that the organophosphorus compound acts as an extractant and its own solvent. For liquid samples of sulfur-bearing material, an excess of the organophosphorus compound is desirable to improve reaction rates.

The sulfur-bearing materials on which the methods of the present invention can be used are any types of solid or liquid coal or petroleum products, although the sulfur may not be removed to the same extent in all materials. For example, the use of $(n\text{-}Bu)_3P$ to remove sulfur from Illinois No. 6 coal without prior impregnation results in the removal of at least about 90% of the sulfur, whereas only about 50–60% of the sulfur in Donna Hill coal can be removed under the same conditions. It is believed, however, that for such coals this difference may be a mechanical problem, which can be overcome by prior vacuum impregnation of the organophosphorus compound. That is, some coals have small channels into which it can be difficult for the organophosphorus compound to penetrate without the use of vacuum impregnation techniques.

As used herein, "coal" or "coal products" refer to coals and solid or liquid coal-derived products. As used herein, "petroleum products" refer to petroleum feedstocks, heavy petroleum residua, and discarded tires, for example, whether solid or liquid. As used herein, "heavy petroleum residua" refers to the components of petroleum feedstocks that have boiling points greater than 350° C. Typically, this is a liquid (e.g., semiliquid) product :remaining after the distillation of lower boiling petroleum components. It contains largely asphaltic hydrocarbons. Examples of sulfur-containing components include benzothiophene and dibenzothiophene and their aliphatic and aromatic substituted derivatives. Heavy residua are also known as residual oil, asphaltum oil, liquid asphalt, black oil, and petroleum tailings.

Preferably, the organophosphorus compounds, i.e., organophosphines and phosphites of the type typically used as ligands in organometallic compounds, are added to solid sulfur-bearing materials, particularly highly porous materials such as coal, while the material is under a reduced pressure, i.e., a pressure below that of atmospheric pressure. Upon restoring the mixture to atmospheric pressure, the organophosphorus compound or mixture of different organophosphorus compounds impregnate the material, e.g., coal, thereby creating better contact between the organophosphorus compound and the material. Preferably, the solid sulfur-bearing material is exposed to a pressure of no greater than about 200 mm Hg, more preferably no greater than about 50 mm Hg, and most preferably no greater than about 0.1 mm Hg. This reduced pressure method, i.e., vacuum impregnation method, is not particularly applicable to liquid coal and petroleum products, although it could be used in certain situations if desired.

The organophosphorus compound can be any organophosphorus compound of the formula $PR_3$ or $P(OR)_3$ (preferably $PR_3$) wherein each R is independently an aliphatic or aromatic group (preferably having no more than about 50 carbon atoms). The organophosphorus compound can be in the form of a solid or a liquid, preferably it is a liquid. It can also be soluble in water, which is advantageous in certain embodiments. Useable organophosphorus compounds include "mixed" phosphines and phosphites, i.e., those compounds in which at least two of the three R groups are different. Thus.; in any one organophosphorus compound the R groups may be the same or different. Such compounds are commercially available from a variety of sources. Examples of suitable organophosphorus compounds include, but are not limited to, trimethyl phosphine, triethyl phosphine, tri-n-propyl phosphine, triisopropyl phosphine, tri-n-butyl phosphine, tri-t-butyl phosphine, tricyclohexyl phosphine, triphenyl phosphine, tri-o-toyl phosphine, tri-p-tolyl phosphine, dimethylphenyl phosphine, di-t-butylphenyl phosphine, trimethyl phosphite, triethyl phosphite, triisopropyl phosphite, tri-n-butyl phosphite, tricyclohexyl phosphite, triphenyl phosphite, tri-o-tolyl phosphite, tri-p-tolyl phosphite, and dimethylphenyl phosphite. The R groups may also be joined in a ring as in methyl trimethylene phosphite or methyl trimethylene phosphine. Preferably, each R is independently a $(C_{1-10})$aliphatic group or a $(C_{5-12})$aromatic group. More preferably, each R is independently a $(C_{2-8})$alkyl group or a $(C_{6-10})$aryl group. Most preferably, each R is independently a $(C_{4-8})$alkyl moiety.

When the sulfur-bearing material is in the form of a liquid, it is advantageous to use an organophosphorus compound bound to a solid support, such as silica or alumina, or a polymer in which the organophosphorus compound is incorporated into the polymer. In this way, the organophosphorus compound can be easily recovered from the material. Such supported organophosphorus compounds can be prepared by methods known in the art, such as the methods described in D. D. Whitehurst, *Chemtech,* 44 (January 1980); J. Albrecht et al., German Patent Document DE 4207299 A1 (Nov. 25, 1993), *Chem. Abstr.,* 120, 191994f; B. L. Booth et al., *J. Chem. Soc. Dalton Trans.,* 1415 (1987); Y. Chen et al., *Yingyong Huaxue,* 6, 1 (1989), Chem. Abstr., 112, 98793q; B. L. Booth et al., *J. Chem. Soc. Dalton Trans.,* 2959 (1987); and R. S. Amos et al., *J. Org. Chem.,* 49, 2637 (1984).

As a means of simplifying the discussion and recitation of certain terminology used herein, the terms "group" and "moiety" are used to differentiate between chemical species that allow for substitution or which may be substituted and those that do not so allow or may not be so substituted. Thus, when the term "group" is used to describe a chemical substituent, the described chemical material includes the unsubstituted group and that group with conventional substitution. When the term "moiety" is used to describe a chemical substituent, only an unsubstituted chemical material is intended to be included. For example, the phrase "alkyl group" is intended to include not only pure open-chain and cyclic saturated hydrocarbon alkyl substituents, such as methyl, ethyl, propyl, n-butyl, cyclohexyl, adamantyl, octadecyl, and the like, but also alkyl substituents bearing further substituents known in the art, such as hydroxyl, alkoxy, halogen, acyl, silyl, amino, and cyano. It would be obvious to one of skill in the art, however, that certain substituents such as hydroxyl and halogen are not suitable for organophosphite compounds. On the other hand, the phrase "alkyl moiety" is limited to the inclusion of only pure open-chain and cyclic saturated hydrocarbon alkyl substituents, such as methyl, ethyl, propyl, n-butyl, cyclohexyl, adamantyl, octadecyl, and the like.

The organophosphorus compound and sulfur-bearing material combined and heated at a temperature and for a time effective to remove at least a portion of the sulfur. Preferably, the reaction mixture is heated at a temperature and for a time effective to remove greater than about 50% of the total amount of sulfur present, whether it is organically or inorganically bound sulfur. More preferably, a sufficient temperature and time are used such that at least about 70% of the sulfur, and most preferably at least about 90% of the sulfur, is removed. Typically, the reaction is carried out at a temperature of at least about 150° C., more preferably at least about 200° C., and most preferably at least about 300° C. The time required for effective removal of sulfur can vary depending on the type of sulfur-bearing material, the amount of sulfur contained therein, the temperature of the reaction, the type of organophosphorus compound used, etc. Typically, a sample of about 1–2 grams of coal containing 5% total sulfur at a temperature of about 250° C. using tri-n-butyl phosphine requires about 24 hours to remove about 90% of the sulfur present.

Whether prior vacuum impregnation, is used or not, the methods of the present invention can be made "catalytic" through the use of hydrogen. By this it is meant that the organophosphorus compound, which typically forms an organophosphorus sulfide compound during the reaction with the sulfur-bearing material, can be regenerated and recycled by reaction with hydrogen gas. This method of using hydrogen to regenerate the organophosphorus compound is referred to herein as hydrodesulfurization. The hydrogen can be added directly to the reaction mixture, i.e., sulfur-bearing material and the organophosphorus compound, during or after the heating stage of the reaction in which the sulfur is removed, thereby causing in situ regeneration of the organophosphorus compound. Alternatively, the organophosphorus sulfide can be removed from the reaction mixture, regenerated with hydrogen, and the regenerated organophosphorus compound directed back into the reaction mixture. In this way, the organophosphorus compound can be used in a catalytic amount, i.e., an amount less than stoichiometric for the amount of sulfur present in the sulfur-bearing material. The regeneration step is carried out at a temperature and for a time sufficient to remove substantially all the sulfur from the organophosphine sulfide compound. Typically, the reaction is carried out at a temperature of at least about 150° C., more preferably at least about 200° C., and most preferably at least about 300° C. The time required for effective regeneration of the organophosphorus compound can vary depending on the type of organophosphorus compound, the temperature of the reaction, the pressure of the reaction, etc.

The hydrogenation of the organophosphorus sulfide compound to regenerate the organophosphorus compound can also be carried out in the presence of a metal sulfide compound or mixture of metal sulfide compounds. The metal sulfide can be included within the reaction mixture of the sulfur-bearing coal or petroleum products and the organophosphorus compound, or it can be added subsequently to the organophosphorus sulfide compound after it is removed from the reaction mixture. If it is used directly in the reaction mixture of the organophosphorus compound, the sulfur-bearing material, and hydrogen, the metal sulfide can be added in the form of either a higher metal sulfide (e.g., $FeS_2$) or a lower metal sulfide (e.g., FeS). If, however, the metal sulfide is used in a separate container to which the organophosphorus sulfide, compound is directed, it is preferably added as the lower metal sulfide (e.g., FeS).

When a metal sulfide is used, such as $FeS_2$, for example, the $FeS_2$ releases a sulfur atom to hydrogen to form hydrogen sulfide and the resultant FeS abstracts a sulfur atom from the organophosphorus sulfide compound to regenerate the organophosphorus compound and $FeS_2$. In this way, the metal sulfide acts as an intermediary for the transport of sulfur from the organophosphorus sulfide compound to hydrogen to form hydrogen sulfide. See Scheme II below. Examples of suitable metal sulfides include, but are not limited to, $FeS_2$, $COS_2$, CuS, $MoS_2$, $WS_2$, $Ni_2S$, and $RuS_2$ (the "higher" metal sulfides), which become FeS, CoS, $Cu_2S$, MoS, WS, NiS, and RuS (the "lower" metal sulfides), respectively, upon reaction with hydrogen. In many coal and residua samples, iron pyrite ($FeS_2$) is naturally present, and thus can play this intermediary role. However, if little or no iron pyrite is present, or if the organophosphine sulfide compound is removed from the reaction mixture before it is regenerated, for example, an amount of a lower metal sulfide can be added to remove sulfur from the organophosphine sulfide, thereby forming a higher metal sulfide which can produce $H_2S$ in the presence of hydrogen and in this way regenerate the lower metal sulfide. Here we use the term "lower" and "higher" sulfide to refer to the lower and higher ratio of sulfur to metal, respectively. Preferably, the metal sulfide is used in an amount of about 25 mole-% of that of the organophosphorus compound, and the regeneration is carried out at a temperature of at least about 150° C., more preferably at least about 200° C., and most preferably at least about 300° C. (whether the regeneration is carried out in situ or in a separate container).

The methods of the present invention using organophosphorus compounds to remove sulfur from sulfur-bearing coal or petroleum products (with or without prior impregnation, with or without the addition of hydrogen, and with or without the addition of a metal sulfide) can be enhanced further by heating the reaction mixture in the presence of a metal catalyst containing a metal in the +2 or +3 oxidation state. Examples of suitable such metals include, but are not limited to +2 and +3 transition metals, rare earth metals, and Group IIIA metals. The metal can be provided to the reaction mixture in the form halides such as $FeCl_2$, $FeCl_3$, carboxylates, carbonates, sulfates, phosphates, nitrates, silicates, and the like. Preferably, the metal is a Group IIIA, VIIB, IB, and VIIIB metal in the +2 or +3 oxidation state. More preferably, this metal is a Group VIIIB metal in the +3 oxidation state. Most preferably, Fe(III) is used to advantage. If desired, an amount of a +2 or +3 metal catalyst can be added to increase the amount of organically bound sulfur removed. Preferably, the +2 or +3 metal compound is used in an amount of about 50 mole-% relative to the organophosphorus compound. More preferably, the +2 or +3 metal compound is used in a catalytic amount, i.e., about 10 mole-%.

The examples listed below demonstrate that: (a) Illinois No. 6 coal loses about 90% of its sulfur in refluxing $(n\text{-}Bu)_3P$ over a 2 day period; (b) prior vacuum impregnation of $(n\text{-}Bu)_3P$ into Illinois No. 6 increases the amount of sulfur removed to about 99% of the sulfur under the same conditions; and (c) the $(n\text{-}Bu)_3P{=}S$ formed in the reaction can be converted back to $(n\text{-}Bu)_3P$ with $H_2$ at 300° C., with concomitant formation of $H_2S$, or it can be reacted with FeS at 260° C. to give $(n\text{-}Bu)_3P$ and $FeS/FeS_2$, which can then be converted back to FeS with $H_2$ at 400° C.

These accomplishments allow the catalytic desulfurization of coal by two routes as shown in Schemes 1 and 2. In scheme 2, $FeS_2$ is the "higher" metal sulfide and FeS is the "lower" metal sulfide.

Scheme 1

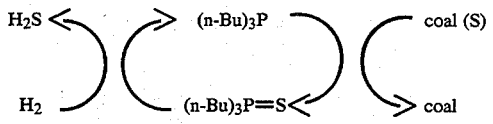

Scheme 2

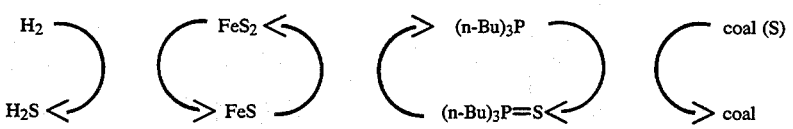

Any of the methods of the present invention can be carried out in a batch process or a continuous flow process. For example, the present invention can be used in a large scale system in which $(n\text{-}Bu)_3P$, for example, is refluxed through an overhead bed of coal while bubbling $H_2$ through the extract to carry away the $H_2S$ from the $(n\text{-}Bu)_3P{=}S$. If, for reaction rate enhancement, the step of hydrogenating the organophosphorus sulfide (e.g., $(n\text{-}Bu)_3P{=}S$) is carried out at a temperature above the boiling point of the corresponding organophosphorus compound (e.g., at about 300° C. for $(n\text{-}Bu)_3P{=}S$, which is about 50° C. higher than the boiling point of $(n\text{-}Bu)_3P$) it may be necessary to carry out this process in a pressure vessel or in a high-boiling hydrocarbon such as Nujol so that the vapor pressure of the organophosphorus compound is reduced sufficiently to raise its boiling point to a temperature where the hydrogenation of organophosphorus sulfide becomes effective. Another way to raise the boiling point of the organophosphorus compound ($PR_3$) is to allow the concentration of the organophosphorus sulfide ($(R)_3P{=}S$) to remain fairly high. Yet another approach is to carry out the sulfur removal at the refluxing temperature of the organophosphorus compound (e.g., 250° C. for $(n\text{-}Bu)_3P$) and then to pump the extract to a higher-pressure vessel where hydrogenation would occur, with subsequent recirculation back to the desulfurizing vessel. Still another approach is to use a higher boiling phosphine such as $(n\text{-}Oct)_3P$ (b.p.=410° C.) and use one vessel.

The lifetime of the organophosphorus compound may be limited by eventual thermal decomposition (although there is no noticeable decomposition during runs lasting a few days in length). There could also be a build-up of $(R)_3P{=}O$; however, this can be isolated by distilling; off the $(PR)_3$ and then reducing $(R)_3P{=}O$ with a silane such as $Cl_3SiH$ (followed by a normal organic preparational work up) and recovery of the $PR_3$.

To apply Scheme 2, one could envision pumping the $(n\text{-}Bu)_3P/(n\text{-}Bu)_3P{=}S$ into an FeS-containing reactor at 320° C., for example, to convert FeS to $FeS_2$ and $(n\text{-}Bu)_3PS$ to $(n\text{-}Bu)_3P$ and then filtering and pumping the $(n\text{-}Bu)_3P$ back to the desulfurizing vessel while the $FeS_2$ was being hydrogenate. This could then be a batch rather than continuous operation (and would only be preferable if for some reason Scheme 1 was not desirable). Other metal sulfide systems could be used such as $COS_2$, CuS and $MoS_2$, for example.

The $FeCl_3$-catalyzed desulfurization of DBT by $(n\text{-}Bu)_3P$ could also be applied to other sulfur-containing materials, e.g., heavy residua. Heating these residua with $H_2$ and catalytic amounts of $(n\text{-}Bu)_3P$ and $FeCl_3$ at 300° C., for example, should generate $(n\text{-}Bu)_3P{=}S$ which would be hydrogenated back to $(n\text{-}Bu)_3P$ in the presence of the $H_2$. When desulfurization is complete, the $(n\text{-}Bu)_3P$ could be distilled (250° C.) out of the reaction mixture to leave the desulfurized residuum. The catalytic $FeCl_3$ or its reaction products would remain in the desulfurized residuum and if it is insoluble, could be filtered off. It may be possible to select Fe(III) salts (or other catalytically active metal salts) that are insoluble to allow easy separation of the residuum from the heterogeneous catalyst.

Rather than using catalytic amounts of $(n\text{-}Bu)_3P$, for example, the residuum could be treated with excess $(n\text{-}Bu)_3P$ and catalytic amounts of $FeCl_3$. After desulfurization, the $(n\text{-}Bu)_3P{=}S$ and unreacted $(n\text{-}Bu)_3P$ could be distilled (340° C.) from the desulfurized residuum. The $(n\text{-}Bu)_3P{=}S$ could then be reduced with $H_2$ at 300° C. to give back $(n\text{-}Bu)_3P$ which would be reused to desulfurize another batch of residuum. Similarly, lighter residues could be hydrodesulfurized by phosphines lower boiling than $(n\text{-}Bu)_3P$.

Discarded tires, which are currently a significant environmental problem, could be desulfurized by the methods described herein. Thus, by melting the rubber, the process would be similar to that described for heavy residua. By pulverizing the tire, the process would be similar to that described for Illinois No. 6 coal, thus allowing desulfurization to occur at lower temperatures than by melting the rubber. Since it is well known that many organic materials swell rubber, some triorganophosphines are also likely to do so, perhaps obviating the necessity to pulverize or melt the rubber.

Another approach to removing sulfur from liquid organic materials is to use an organophosphine that is soluble in both organic media as well as water. After the sulfur has reacted to make the corresponding sulfide, the desulfurized organic material is extracted with water, which will remove the organophosphine sulfide for treatment with hydrogen and subsequent recycling, and will also extract the metal +2 or +3 catalyst if it is used. Water soluble organophosphines are well known in the art and are characterized by the presence of water solubilizing groups such as sulfonate, hydroxyl, amino, ethylene glycol ether ($OCH_2CH_2O$) or carboxyl functionalities. Syntheses for such phosphines are well known in the art. See, for example, F. Mercier et al., *J. Organornet. Chem.*, 462, 103 (1993); D. Darensbourg et al., *Inorg. Chem.*, 33, 175 (1994); and T. N. Mitchell et al., *J. Organomet. Chem.*, 436, 43 (1992). In this embodiment, the organophosphorus compounds are sufficiently soluble in water to allow for effective extraction by water.

As stated previously, the methods of the present invention can be applied to a variety of sulfur-containing materials, whether solid or liquid. They are particularly applicable to coal and petroleum products with large amounts of organically bound sulfur. Furthermore, significant advantage is realized when reduced pressures are used with porous solid sulfur-bearing materials. Also, the methods of the present invention are advantageous because elevated pressures are not generally used or desired.

The invention will be further described by reference to the following detailed examples. These examples are offered to further illustrate the various specific and preferred embodiments and techniques. It should be understood, however, that many variations and modifications may be made while remaining within the scope of the present invention.

Experimental Examples

Illinois No. 6 coal (80 mesh) was kept in a dry box filled with nitrogen. $(n\text{-}Bu)_3P$ (90%, Aldrich Chemical Co., Milwaukee, Wis.) was distilled before use (b.p. 55°–60° C., 0.1 mm Hg). $Ph_3P$ (Aldrich) was recrystallized from ether and pentane. FeS (Aldrich), dibenzothiophene (Johnson and Mathey, Wardhill, Mass.) and $(n\text{-}Oct)_3P$ (Alfa, a division of Johnson and Mathey, Wardhill, Mass.) were used as received. Anhydrous $FeCl_3$ was prepared by reacting $FeCl_3.6H_2O$ with excess 2,2-dimethoxypropane for 20 hours at room temperature, followed by filtering and drying under vacuum. $(n\text{-}Bu)_3P{=}S$ was prepared by reacting $(n\text{-}Bu)_3P$ with an equivalent of elemental sulfur at 0° C. for 1 hour in pentane. The pentane was removed under vacuum and the $(n\text{-}Bu)_3P{=}S$ was distilled under reduced pressure (b.p. 80°–85° C. at 0.05 mm Hg). $Ph_3PCH_3I$, the $^{31}$ PMR quantitation standard, was prepared by dissolving $Ph_3P$ in $CH_3CN$ and adding an equimolar amount of $CH_3I$ at 0° C. The precipitated solid was filtered and recrystallized from $CH_3CN$ and ether. Iron pyrite ($FeS_2$) was obtained from the Iowa State University Geology Department and was powdered to approximately 200 mesh size. Coal-derived pyrites were obtained from Iowa Childer's coal.

Acetonitrile was dried and distilled over $P_4O_{10}$ and $CaH_2$ and was then stored over $CaH_2$. Pyridine was dried and distilled over $CaH_2$ and stored over molecular sieves. All reactions and other manipulations were carried out in an inert atmosphere of nitrogen using Schlenk lines and Schlenk glassware.

Sulfur analyses of the $PR_3$/coal extracts and $PR_3$/dibenzothiophene reaction mixtures were carried out using quantitative $^{31}P$ NMR techniques described in T. Mohan et al., *Energy and Fuels*, 7, 222 (1993), which is incorporated herein by reference. An aliquot of the reaction extract was dissolved in anhydrous pyridine (4 mL) in a 10 mm NMR tube containing a known amount of $Ph_3PCH_3I$ as an internal standard. From the integral value of the $^{31}P$ NMR resonance for $(n\text{-}Bu)_3P{=}S$ or $(n\text{-}Oct)_3P{=}S$, the total amount of sulfur extracted was calculated. An aliquot of extract was also sealed in a tube under vacuum for sulfur analysis.

EXAMPLE 1

Reaction of Illinois No. 6 Coal with $(n\text{-}Bu)_3P$ Without Prior Vacuum Impregnation $(n\text{-}Bu)_3P$ (5 mL) was added to Illinois No. 6 coal (0.959 g) in a 50 mL Schlenk flask and the contents were refluxed (250° ) for 2 days under a nitrogen atmosphere. The reaction mixture was brought to room temperature and filtered. Using a syringe, 1 mL of the filtrate was removed and dissolved in dry pyridine (4 mL) containing $Ph_3PCH_3I$ (0.018 g; 0.044 mmol) as the internal standard in a 10 mm NMR tube. The $^{31}P$ NMR analysis was carried out and from the integral value of the $^{31}$ P NMR resonance for the (n-Bu)3P=S, the total amount of sulfur extracted was found to be 91%.

A similar reaction was reported by J. Hoots, Ph.D. Thesis, University of Illinois (1984) using Springfield No. 5 coal, anhydrous Nujol, and $(n\text{-}Bu)_3P$ at 260°–270° C. for 2 hours. This resulted in only 50% sulfur extraction.

EXAMPLE 2

Reaction of Illinois No. 6 Coal with $(n\text{-}Bu)_3P$ With Prior Vacuum Impregnation Illinois No. 6 coal (2.048 g) was placed in a 50 mL Schlenk flask which was then evacuated to 0.1 mm Hg. Through a septum, $(n\text{-}Bu)_3P$ (5 mL) was added and the contents stirred for ½ hour at room temperature. The flask was brought to atmospheric pressure with a nitrogen atmosphere and then the reaction mixture was refluxed for 2 days. The flask was then brought back to room temperature and the mixture filtered. A 1 mL portion of the extract was subjected to $^{31}$ P NMR analysis using $Ph_3PCH_3I$ (0.024; 0.059 mmol) as the internal standard. From the $^{31}$ P NMR integral of the $(n\text{-}Bu)_3P{=}S$ peak, the amount of sulfur extracted was found to be 99%.

EXAMPLE 3

Hydrogenation of $(n\text{-}Bu)_3P{=}S$ $(n\text{-}Bu)_3P{=}S$ (0.48 g; 2.5 mmol) was placed in a quartz weighing boat which was inserted into a quartz tube. Hydrogen gas was slowly passed through one end of the tube. The other end was connected to an ice trap (to condense any escaping $(n\text{-}Bu)_3P$ vapor) and then to an ammoniacal solution of $Zn(NO_3)_2$. The quartz tube was slowly heated to 300° C. Within about ½ hour at 300° C., the $Zn(NO_3)_2$ solution became turbid. This turbidity increased gradually with time. This implied the formation of ZnS obtained by the reaction of $Zn(NO_3)_2$ with $H_2S$ liberated by reduction of $(n\text{-}Bu)_3P{=}S$ by $H_2$. Since some evaporation of $(n\text{-}Bu)_3P{=}S$ was unavoidable under these conditions, the reaction was not quantified.

EXAMPLE 4

Reaction of $(n\text{-}Bu)_3P{=}S$ with FeS

Powdered FeS (0.264 g; 3.00 mmol) of approximately 200 mesh was placed in an 8 mm tube and $(n\text{-}Bu)_3P{=}S$ (1.000 g; 4.310 mmol) was added. The tube was evacuated to 0.1 mm Hg and then it was flame sealed. The contents were heated at 320° C for 17 hours after which the reaction mixture was dissolved in dry pyridine (4 mL), filtered, and the filtrate subjected to $^{31}$P NMR analysis. The $^{31}$P NMR spectrum showed a resonance for $(n\text{-Bu})_3P$ at −32 ppm whose integral indicated that about 10% of this compound had formed. The peak for unreacted $(n\text{-Bu})_3P{=}S$ appeared at 49 ppm.

EXAMPLE 5

Reaction of $(n\text{-Bu})_3P$ with $FeS_2$

Powdered $FeS_2$ (0.524 g, 4.37 mmol) of approximately 200 mesh was placed in an 8 mm tube. To this was added $(n\text{-Bu})_3P$ (1.5 mL) and then the tube was evacuated to 0.1 mm Hg. The tube was flame sealed and heated at 280° C. for 15 hours. The contents were then mixed with dry pyridine (4 mL) and filtered. The $^{31}$P NMR spectrum of the filtrate was taken with $Ph_3PCH_3I$ (0.014 g, 0.036 mmol) as the internal standard. From the integral value of the $^{31}$P resonance for the $(n\text{-Bu})_3P{=}S$, the amount of sulfur extracted from $FeS_2$ was calculated to be 37%. The elemental sulfur analysis of the extract showed a similar value (38.56%).

EXAMPLE 6

Reaction of $(n\text{-Bu})_3P$ With Coal-Derived Pyrites

A coal-derived pyrite sample (1.0517 g) was refluxed with $(n\text{-Bu})_3P$ (4 mL) for 17 hours. The reaction mixture was then brought to room temperature and filtered. An aliquot (1 mL) of the extract was dissolved in $CDCl_3$ (4 mL) containing $Ph_3PCH_3I$ (0.025 g; 0.061 mmol) as the internal standard. From the $^{31}$P integral of the resonance for $(n\text{-Bu})_3P{=}S$, the sulfur extracted was calculated to be 84%.

EXAMPLE 7

Reactions of $(n\text{-Bu})_3P$ with dibenzothiophene (DBT)

a) With no metal catalyst

Dibenzothiophene (0.202 g; 1.10 mmol) was refluxed with $(n\text{-Bu})_3P$ (2 mL) for 17 hours. The reaction mixture was dissolved in $CDCl_3$ (2 mL). Its $^{31}$P NMR spectrum revealed no peak for $(n\text{-Bu})_3P{=}S$.

b) With graphite as a potential catalyst

The above experiment was repeated with graphite as a potential catalyst. However, no $^{31}$p NMR peak for $(n\text{-Bu})_3P{=}S$ was observed in the reaction mixture.

c) With Fe(0) generated as a potential catalyst

Elemental sodium (0.163 g; 7.09 mmol) was added to a solution of naphthalene (0.908 g, 7.09 mmol) in THF (15 mL). The reaction mixture slowly developed a dark greenish blue color. After 15 hours, the solution became clear. This solution was added to a mixture of $FeCl_3$ (0.384 g, 2.37 mmol), DBT (0.435 g; 2.37 mmol), and $(n\text{-Bu})_3P$ (3.82 mL) in toluene (10 mL). The reaction mixture became dark brown. After stirring for 10 hours at room temperature, the solution was concentrated to about 5 mL. The $^{31}$P NMR spectrum was taken with $Ph_3PCH_3I$ as internal standard but no peak for $(n\text{-Bu})_3P{=}S$ was observed.

d) With $FeCl_2$ as a potential catalyst $FeCl_2$ (0.099 g; 1.1 mmol) was mixed with DBT (0.554 g; 3.01 mmol) in a 50 mL Schlenk flask. To this, $(n\text{-Bu})_3P$ (5 mL) was added and the contents were refluxed for 17 hours. The reaction mixture was then filtered and the extract was dissolved in pyridine (4 mL) containing $Ph_3PCH_3I$ (0.014 g, 0.035 mmol). The $^{31}$P spectrum of this mixture showed a peak for the $(n\text{-Bu})_3P{=}S$. From the integral, the amount of sulfur extracted was calculated to be 4.2%.

e) With anhydrous $FeCl_3$

DBT (0.095 g; 0.52 mmol) was mixed with anhydrous $FeCl_3$ (0.023 g; 0.14 mmol) and $(n\text{-Bu})_3P$ (3 mL). The reaction mixture immediately turned violet and upon refluxing this color slowly faded to yellow orange. After 17 hours, the reaction mixture was cooled to room temperature and 1 mL of it was subjected to $^{31}$P NMR spectroscopy with $Ph_3PCH_3I$ (0.039 g; 0.097 mmol) as the internal standard. From the $^{31}$P integral of the resonance for $(n\text{-Bu})_3P{=}S$, the total amount of sulfur removed was calculated to be 98%.

EXAMPLE 8

Reaction of Illinois No. 6 with $PPh_3$

Illinois No. 6 coal (3.034 g) was mixed well with $Ph_3P$ (3.200 g; 0.01300 mol). The mixture was refluxed (370° C.) for 2 days, after which it was cooled to room temperature and extracted with THF (3×5 mL). The THF washings were evaporated, dissolved in $CDCl_3$ (4 mL), and then the $^{31}$P NMR spectrum was taken with $Ph_3PCH_3I$ (0.028 g; 0.069 mmol) as the internal standard. From the integral of the resonance for $Ph_3P{=}S$, the total amount of sulfur extracted was calculated to be 0.43%. It is believed that this value could be improved by evacuating the mixture at room temperature, melting the $Ph_3P$ and then bringing the system back to atmospheric pressure before refluxing.

EXAMPLE 9

Reaction of $(n\text{-Oct})_3P$ With Illinois No. 6 Coal

Illinois No. 6 coal (1.618 g) was refluxed (410° C.) with (n-Oct)3P (4 mL) for 2 days. The reaction mixture was then filtered (filtration was quite difficult due to the viscosity of the extract). The viscous extract was dissolved in 0.3 mL of pyridine and then 1 mL of this solution was subjected to $^{31}$P NMR spectroscopy with $Ph_3PCH_3I$ (0.013 g; 0.032 mmol) as the internal standard. From the $^{31}$P integral of the resonance for $(n\text{-Oct})_3P{=}S$, the total amount of sulfur extracted was calculated to be 80%.

EXAMPLE 10

Hydrogenation of $FeS_2$

Powdered $FeS_2$ (1.141 g, 1.00 mmol) was placed in a weighing boat which was then inserted into a quartz tube. Through one end of the tube, H2 gas was slowly passed. The other end of the tube was connected to an ammoniacal solution of $Zn(NO_3)_2$. The tube was heated at 400° C. in a tube furnace for 9 hours. The $Zn(NO_3)_2$ solution became turbid and produced a white precipitate owing to the formation of ZnS. After 9 hours, the tube was brought back to room temperature. The amount of the residue (0.752 g) corresponded to a loss of close to one sulfur atom from $FeS_2$. This was substantiated by the X-ray powder pattern of the solid residue which showed lines for FeS only.

EXAMPLE 11

Continuous Flow Hydrodesulfurization

To 4.0 mL of $(n\text{-Oct})_3P$ was added 1.6 g of Illinois No. 6 coal. The mixture was refluxed (410° C.) while $H_2$ was bubbled through the mixture. The effluent gas was passed through a $Zn(NO_3)_2$ solution. Over a period of 17 hours a white precipitate of ZnS was noted to form in the $Zn(NO_3)_2$ solution.

EXAMPLE 12

Reaction of Donna Hill Coal With $(n\text{-}Bu)_3P$ Without Prior Vacuum Impregnation $(n\text{-}Bu)_3P$ (5 mL) was added to Donna, Hill coal (0.959 g) in a 50 mL Schlenk flask and the contents were refluxed (250° C.) for 2 days. The reaction mixture was brought to room temperature and filtered. Using a syringe, 1 mL of the filtrate was removed and dissolved in dry pyridine (4 mL) containing $Ph_3PCH_3I$ (0.018 g; 0.044 mmol) as the internal standard in a 10 mm NMR tube. The $^{31}P$ NMR analysis was carried out and from the integral value of the $^{31}P$ NMR resonance for the $(n\text{-}Bu)_3P{=}S$, the total amount of sulfur extracted was found to be 57%.

EXAMPLE 13

Reaction of Spanish Lignite With $(n\text{-}Bu)_3P$ Without Prior Vacuum Impregnation $(n\text{-}Bu)_3P$ (5 mL) was added to Spanish Lignite coal (0.959 g) in a 50 mL Schlenk flask and the contents were refluxed (250° C.) for 2 days. The reaction mixture was brought to room temperature and filtered. Using a syringe, 1 mL of the filtrate was removed and dissolved in dry pyridine (4 mL) containing $Ph_3PCH_3I$ (0.018 g; 0.044 mmol) as the internal standard in a 10 mm NMR tube. The $^{31}P$ NMR analysis was carried out and from the integral value of the $^{31}P$ NMR resonance for the $(n\text{-}Bu)_3P{=}S$, the total amount of sulfur extracted was found to be 91%.

Discussion of Results

Illinois No. 6 coal contains a total of 4.73% sulfur of which 35.96% is organic, 63.47% is pyritic sulfur ($FeS_2$), and 6.57% is present as $SO_4^{2-}$. The removal of 99% of the total sulfur (Example 2) implies that virtually all of the organic sulfur, including thiophenic sulfur, is extracted by the $(n\text{-}Bu)_3P$. This was unexpected because a separate experiment (Example 7a) did not result in the removal of any detectable sulfur from DBT using $(n\text{-}Bu)_3P$ under the same conditions. Surprisingly, however, addition of a catalytic amount of Illinois No. 6 resulted in 28% sulfur extraction from DBT. To determine whether this was a surface phenomenon, graphite was used instead of the coal, but it induced no detectable sulfur extraction from DBT (Example 7b). To determine whether it might be iron that catalyzes sulfur removal from DBT (iron is present in an amount of about 0.80% in Illinois No. 6), Fe(0) was used, which resulted in 0% sulfur removal (Example 7c), as was $FeCl_2$, which resulted in less than 5% sulfur removal (Example 7d). However, when a catalytic amount of $FeCl_3$ was used, the sulfur was removed quantitatively from DBT (Example 7e).

The removal of 99% of the total sulfur from Illinois No. 6 with $(n\text{-}Bu)_3P$ also implies that virtually all of the inorganic sulfur is removed. Since most (63.47%) of the inorganic sulfur is present as $FeS_2$, this was surprising because it had been previously reported that the treatment of $FeS_2$ with $(n\text{-}Bu)_3P$ at a temperature 10° C. higher resulted in only 50% sulfur removal, giving FeS (J. Hoots, Ph.D. Thesis, University of Illinois (1984)). Moreover, when the J. Hoots experiment was repeated, only 37% of the sulfur was extracted (Example 5). On the other hand, when a sample of coal-derived pyrite (rather than pure $FeS_2$) was treated with $(n\text{-}Bu)_3P$, 84% of the sulfur was removed (Example 6).

Other coals, such as Donna Hill (2.71% S, 7.75% iron) and Spanish Lignite (9.31% S, 1.26% iron) were desulfurized using the method of the invention (without vacuum impregnation) but not to the same extent as was Illinois No. 6. It is believed that this was due to mechanical factors rather than, or in addition to, chemical factors. It is further believed that these values could be increased if the coal were first vacuum impregnated with the organophosphorus compound.

Other phosphorus-containing compounds were used, such as $P_4$ (refluxed in toluene for 24 hours) and $P(NMe_2)_3$ (15 hours at 50° C.); but with no removal of sulfur. Thus, useful organophosphorus compounds are those containing only P—C or P—O bonds.

The complete disclosure of all patents, patent documents, and publications cited herein are incorporated by reference. The foregoing detailed description and examples have been given for clarity of understanding only. No unnecessary limitations are to be understood therefrom. The invention is not limited to the exact details shown and described, for variations obvious to one of skill in the art will be included within the invention defined by the claims.

What is claimed is:

1. A method for the removal of sulfur from solid sulfur-bearing materials comprising:

(a) exposing a sample of the solid sulfur-bearing material to a reduced pressure;

(b) contacting the sample of solid sulfur-bearing material under a reduced pressure with an organophosphorus compound of the formula $PR_3$ or $P(OR)_3$, wherein each R is independently an aliphatic or aromatic group; and (c) heating the mixture of the solid sulfur-bearing material and organophosphorus compound at a temperature and for a time sufficient to remove at least a portion of the sulfur.

2. The method of claim 1 wherein each R is independently a $(C_{1\text{-}50})$aliphatic group or a $(C_{5\text{-}50})$aromatic group.

3. The method of claim 2 wherein the organophosphorus compound is water soluble.

4. The method of claim 2 wherein R is a $(C_{2\text{-}8})$alkyl group or a $(C_{6\text{-}10})$aryl group.

5. The method of claim 1 wherein the step of heating includes heating the mixture in the presence of a metal catalyst having a metal in the +2 or +3 oxidation state.

6. The method of claim 5 wherein the step of heating includes heating the mixture in the presence of hydrogen.

7. The method of claim 1 wherein the step of heating includes heating the mixture in the presence of hydrogen.

8. The method of claim 7 wherein the step of heating includes heating the mixture in the presence of a metal sulfide.

9. A method for the removal of sulfur from liquid sulfur-bearing materials comprising:

(a) contacting a sample of the liquid sulfur-bearing material with an organophosphorus compound of the formula $PR_3$ or $P(OR)_3$, wherein each R is independently an aliphatic or aromatic group; and (b) heating the mixture of the liquid sulfur-bearing material and organophosphorus compound at a temperature and for a time sufficient to remove at least a portion of the sulfur.

10. The method of claim 9, wherein each R is independently a ($C_{1-50}$)aliphatic group or a ($C_{5-50}$)aromatic group.

11. The method of claim 10 wherein the organophosphorus compound is soluble in water.

12. The method of claim 9 wherein the organophosphorus compound is bound to a solid support.

13. The method of claim 9 wherein the step of heating includes heating the mixture in the presence of a metal catalyst having a metal in the +2 or +3 oxidation state.

14. The method of claim 9 wherein the step of heating includes heating the mixture in the presence of hydrogen.

15. The method of claim 14 wherein the step of heating includes heating the mixture in the presence of a metal sulfide.

16. A method for the removal of sulfur from sulfur-bearing materials comprising:

(a) contacting a sample of the sulfur-bearing material with an organophosphorus compound of the formula $PR_3$ or $P(OR)_3$, wherein each R is independently an aliphatic or aromatic group; and (b) heating the mixture of the sulfur-bearing material and organophosphorus compound at a temperature and for a time sufficient to remove greater than about 50% of the total sulfur.

17. The method of claim 16 wherein at least about 70% of the total sulfur is removed.

18. The method of claim 16 wherein at least about 90% of the total sulfur is removed.

19. The method of claim 16 wherein each R is independently a ($C_{1-50}$)aliphatic group or a ($C_{5-50}$)aromatic group.

20. The method of claim 16 wherein the step of heating includes heating the mixture in the presence of a metal catalyst having a metal in the +2 or +3 oxidation state.

21. The method of claim 16 wherein the step of heating includes heating the mixture in the presence of hydrogen.

22. The method of claim 21 wherein the step of heating includes heating the mixture in the presence of a metal sulfide.

23. The method of claim 16 wherein the organophosphorus compound is water soluble.

24. A method for the removal of sulfur from sulfur-bearing materials comprising:

(a) contacting a sample of the sulfur-bearing material with an organophosphorus compound of the formula $PR_3$ or $P(OR)_3$, wherein each R is independently an aliphatic or aromatic group;

(b) heating the mixture of sulfur-bearing material and organophosphorus compound at a temperature and for a time sufficient to remove at least a portion of the sulfur from the sulfur-bearing material and form an organophosphorus sulfide compound; and (c) heating the organophosphorus sulfide compound in the presence of hydrogen at a temperature and for a time sufficient to regenerate the organophosphorus compound.

25. The method of claim 24 wherein the organophosphorus sulfide compound is removed from the reaction mixture prior to heating it in the presence of hydrogen.

26. The method of claim 24 wherein the heating steps (b) and (c) occur simultaneously in one reaction mixture.

27. The method of claim 24 wherein the heating steps are carried out at a temperature of at least about 150° C.

28. The method of claim 24 wherein the step of heating the mixture of sulfur-bearing material and the organophosphorus compound includes heating in the presence of a metal catalyst containing a metal in the +2 or +3 oxidation state.

29. The method of claim 28 wherein the organophosphorus compound is present in a catalytic amount and the heating steps are carried out simultaneously in one reaction mixture.

30. The method of claim 28 wherein the organophosphorus compound is present in an excess amount and the organophosphorus sulfide compound is removed from the reaction mixture prior to heating it in the presence of hydrogen.

31. The method of claim 24 wherein the step of heating the mixture of sulfur-bearing material and the organophosphorus compound includes heating in the presence of a metal sulfide.

32. The method of claim 24 wherein the step of contacting the sulfur-bearing material with an organophosphorus compound is carried out while the sulfur-bearing material is under a reduced pressure.

33. The method of claim 24 wherein the organophosphorus compound is water soluble.

34. A method for the removal of sulfur from sulfur-bearing materials comprising:

(a) contacting a sample of the sulfur-bearing material with an organophosphorus compound of the formula $PR_3$ or $P(OR)_3$, wherein each R is independently an aliphatic or aromatic group;

(b) heating the mixture of sulfur-bearing material and organophosphorus compound at a temperature and for a time sufficient to remove greater than about 50% of the total sulfur and form an organophosphorus sulfide compound;

(c) heating the organophosphorus sulfide compound in the presence of a lower metal sulfide compound to form a higher metal sulfide compound and regenerate the organophosphorus compound; and (d) heating the higher metal sulfide compound in the presence of hydrogen at a temperature and for a time sufficient to form hydrogen sulfide and regenerate the lower metal sulfide compound.

35. The method of claim 34 wherein each R is independently a ($C_{1-50}$)aliphatic group or a ($C_{5-50}$)aromatic group, 36. The method of claim 34 wherein the step of contacting the sulfur-bearing material with the organophosphorus compound is carried out while the coal or petroleum product is under a reduced pressure.

37. The method of claim 34 wherein the organophosphorus compound is bound to a solid support.

38. The method of claim 34 wherein the organophosphorus compound is water soluble.

39. A method for the removal of sulfur from sulfur-bearing material comprising:

(a) contacting a sample of the sulfur-bearing material with an organophosphorus compound of the formula $PR_3$ or $P(OR)_3$, wherein each R is independently an aliphatic or aromatic group;

(b) heating the mixture of sulfur-bearing material and organophosphorus compound in the presence of a metal catalyst containing a metal in the +2 or +3 oxidation state at a temperature and for a time sufficient to remove at least a portion of the sulfur.

40. The method of claim 39 wherein each R is independently a ($C_{1-50}$)aliphatic group or a ($C_{5-50}$)aromatic group.

41. The method of claim 39 wherein the organophosphorus compound is water soluble.

42. The method of claim 39 wherein the organophosphorus compound is bound to a solid support.

43. The method of claim 39 wherein the step of contacting the sulfur-bearing material with the organophosphorus compound is carried out while the coal or petroleum product is under a pressure of no greater than about 0.1 mm Hg.

44. The method of claim 39 wherein the organophosphorus compound is present in a catalytic amount and the mixture includes hydrogen.

45. The method of claim 39 wherein the heating steps are carried out at a temperature of at least about 150° C.

* * * * *

UNITED STATES PATENT AND TRADEMARK OFFICE

CERTIFICATE OF CORRECTION

PATENT NO.: 5,437,696
DATED: August 1, 1995
INVENTOR(S): Verkade et al.

It is certified that error appears in the above-identified patent and that said Letters Patent is hereby corrected as shown below:

Col. 1, line 18, delete "chart-ing" and insert --char-ring--

Col. 1, line 38, delete "FeS2" and insert --$FeS_2$--

Col. 1, line 39, delete "(n-Bu)3P" and insert --$(n\text{-}Bu)_3P$--

Col. 2, line 10, delete "PR3" and insert --$PR_3$--

Col. 2, line 10, delete "P(OR)3" and insert --$P(OR)_3$--

Col. 6, line 25, delete "$COS_2$" and insert --$CoS_2$--

Col. 8, line 12, delete "hydrogenate" and insert --hydrogenated--

Col. 8, line 16, delete "$COS_2$" and insert --$CoS_2$--

Col. 9, line 8, delete "*Organornef*" and insert --*Organomet*--

Col. 9, line 41, delete "$FeCl_3.6H_2O$" and insert --$FeCl_3 \bullet 6H_2O$--

Col. 10, line 20, delete "(n-Bu)3P" and insert --$(n\text{-}Bu)_3P$--

Col. 12, line 33, delete "(n-Oct)3P" and insert --$(n\text{-}Oct)_3P$--

Signed and Sealed this

Seventeenth Day of June, 1997

*Attest:*

*Attesting Officer*

BRUCE LEHMAN

*Commissioner of Patents and Trademarks*